United States Patent [19]

Rumpp et al.

[11] Patent Number: 4,549,616

[45] Date of Patent: Oct. 29, 1985

[54] ROCK DRILL

[75] Inventors: Gerhard Rumpp, Inning; Dieter Scholz, Unterpfaffenhofen, both of Fed. Rep. of Germany

[73] Assignee: Hilti Aktiengesellschaft, Fünstentum, Liechtenstein

[21] Appl. No.: 597,457

[22] Filed: Apr. 5, 1984

Related U.S. Application Data

[63] Continuation-in-part of Ser. No. 253,559, Apr. 13, 1981, Pat. No. 4,458,769.

[30] Foreign Application Priority Data

Apr. 16, 1980 [DE] Fed. Rep. of Germany ..... 3014693

[51] Int. Cl.[4] ..... E21B 10/44

[52] U.S. Cl. ..... 175/394; 175/323; 408/226; 408/230

[58] Field of Search ..... 175/394, 323, 395, 396; 408/226, 230, 199, 210

[56] References Cited

U.S. PATENT DOCUMENTS

| | | | |
|---|---|---|---|
| 1,216,628 | 2/1917 | Teasck | 408/228 |
| 3,045,513 | 7/1962 | Andreason | 408/230 |
| 3,749,189 | 7/1973 | Boehm | 175/394 |
| 4,091,693 | 5/1978 | Straub | 175/394 |

FOREIGN PATENT DOCUMENTS

| | | | |
|---|---|---|---|
| 1471067 | 2/1967 | France | 175/323 |
| 594314 | 2/1978 | U.S.S.R. | 175/394 |

*Primary Examiner*—James A. Leppink
*Assistant Examiner*—Hoang C. Dang
*Attorney, Agent, or Firm*—Toren, McGeady, Stanger, Goldberg & Kiel

[57] ABSTRACT

A rock drill is formed of an axially elongated member made up of a cutting bit at one end followed by a helically grooved shaft and then ending in a shank. At least a portion of the groove, viewed in the axial direction of the member, has a stepped bottom providing groove sections of different depths. The depth of the groove section from the surface of the shaft decreases in the direction toward the shank. The groove sections with stepped bottom commence at a certain axial length from the cutting bit.

6 Claims, 4 Drawing Figures

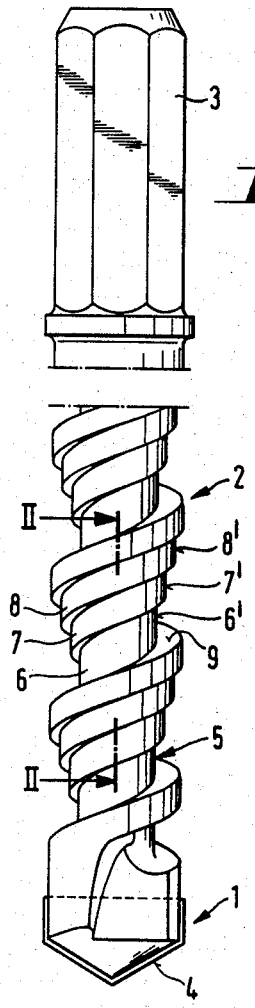
Fig. 1
Fig. 2
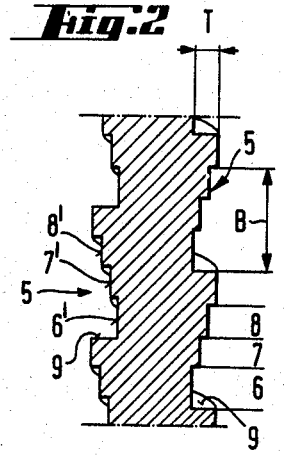
Fig. 3
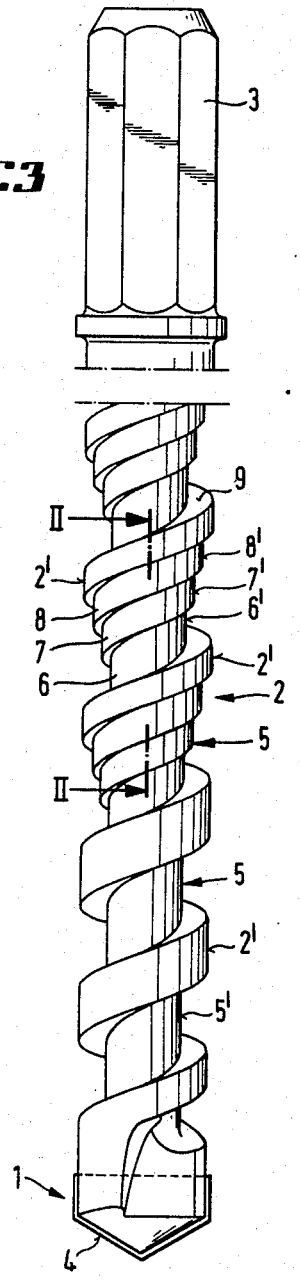

ROCK DRILL

CROSS REFERENCE TO RELATED APPLICATIONS

This is a continuation-in-part of application Ser. No. 253,559 filed Apr. 13, 1981 now U.S. Pat. No. 4,458,769.

SUMMARY OF THE INVENTION

The present invention is directed to a rock drill having a cutting bit at one end followed by a shaft and then a shank. The shaft aids in the removal of drill borings from the borehole and has one or more removal grooves which extend helically between the cutting bit and the shank. Viewed in the axial direction of the rock drill, the removal grooves have a groove bottom which extends parallel to the axis of the drill and a side wall or flank closer to the cutting bit which extends perpendicularly of the drill axis.

Known rock drills have one or possibly several helically extending removal grooves in the shaft for conveying the drill borings away from the cutting head—analogous to a feed screw—during the drilling process for carrying the drill borings out of the borehole. Such a drill boring removal procedure is without any significant problems when the drilling is carried out in the horizontal or vertically upward direction. When the drilling is performed vertically downwardly, however, the removal of the drill borings often leads to difficulties.

The removal of drill borings according to the feed screw principle is possible only when there is greater friction between the borings in the groove and the walls of the borehole than between the borings and the surface of the removal groove. To provide these friction ratios, the surface of the removal groove is usually smooth. Only under such conditions can the removal groove force the borings supported at the walls of the borehole from the depth of the borehole to its outlet with the aid of the rotating grooves inclined with respect to the axis of the drill.

If the friction ratios are not as required, that is, if the contact between the drill borings and the walls of the borehole is too small, the borings remain in the region of the removal groove and are moved only in a circle within the borehole due to the rotation of the drill. The removal of these borings may possibly occur if the cutting bit continues pressing the borings into the removal groove, however, under such circumstances the borings are heavily compressed and are pushed slightly along the removal groove toward the borehole outlet or opening. Such drill borings removal is not based on the feed screw principle. When the drill borings are forced out of the borehole in this manner there is a tendency for the drill to become jammed which results in a significant reduction in drilling progress.

In addition to the sufficient size of the cross section of the removal groove, it is particularly important for the removal of the drill borings according to the feed screw principle, that the groove bottom, as is known, viewed in the axial direction of the drill extends parallel to the drill axis. When the groove is sufficiently filled with drill borings, the groove bottom effects a pressurization of the borings against the walls of the borehole at a right angle so that the borings are removed in the desired manner due to the greater frictional resistance of the borings relative to the borehole walls.

In a known drill, viewed in the axial direction of the drill, the removal groove has essentially the shape of a rectangular recess. It has proven in such an arrangement that the groove is sized either too small or too large, depending on the accumulation of borings which, in turn, depend on the different strengths of the material to be drilled or on the changing cutting quality of the drill. If the cross section of the removal groove is too small relative to the accumulation of the borings, as is usually the case in small diameter drills because of strength reasons, then the groove becomes blocked and at most the removal of the borings results from the application of force with the disadvantages mentioned above. If the removal groove is too large, however, then the borings do not fill the cross section of the groove and form a loose filling within the groove. Consequently, at most, there is an insufficient pressing of the borings against the borehole walls and an unsatisfactory removal of the borings results.

Therefore, it is the primary object of the present invention to provide a high strength rock drill with good drill borings removal even for small diameter drills.

In accordance with the present invention, such a rock drill is provided by forming at least a part of the groove bottom along its length with stepped sections as viewed in the axial direction of the drill with each groove section having a different depth and with the depths decreasing in the direction away from the cutting bit. The removal groove with the stepped groove bottom extends from the cutting bit rearwardly to the shank. As the drill borings pass from the cutting bit into the removal groove they accumulate initially in the groove section having the maximum depth which is closest to the cutting bit. This groove section will fill during an average accumulation of borings so that the corresponding groove bottom presses the borings against the borehole walls. If more borings accumulate, they flow into the next section having a somewhat smaller depth and the corresponding groove bottom, which extends parallel to the axis of the drill, presses the borings against the borehole walls. Consequently, when the accumulation of borings vary, the continued pressing of the borings against the borehole walls can be achieved which is necessary for their advantageous removal based on the feed screw principle whereby an effective removal takes place.

In particular in rock drills which have a long shaft for drilling deep boreholes, it may be advantageous for reasons of strength to construct the removal groove with a stepped groove depth over only a part of the overall groove length. In such rock drills, the groove portion with a uniform depth is provided between the stepped groove portion and the cutting bit. Preferably, the portion of the groove length having axial sections of different depths commences at a distance from the drilling bit of about three to seven times the diameter of the cutting bit. Such a length ratio represents an optimum between good removal capacity and high resistance to wear or bending strength. In the part of the removal groove adjoining the cutting bit, the borings are pushed along by the action of the cutting bit. When the drill borings arrive in the portion of the removal groove having stepped depths, the borings are further transported in the manner described above based on the feed screw principle.

For the simple production of a rock drill with a good drill boring removal capacity, it is advantageous if the groove bottom extending in the axial direction of the shaft is divided into two sections each with a different depth. This embodiment is especially suitable when the drill is to be used in a specific material having a generally uniform strength. If the drill is to be used in a variety of materials, however, it is more advantageous to divide the groove bottom into three axially extending sections each of a different depth. Accordingly, due to its exceptional adaptation to various removal conditions based on the amount of drill borings produced by the cutting bit, such a drill is universally capable of moving the borings without any disadvantageous effect on the manufacture of the drill.

In view of the maximum removal capacity and high strength of the drill even at small diameters, an optimum construction of the removal groove is achieved in accordance with the present invention when the maximum depth of the groove compared to its width measured in the axial direction of the drill is in a ratio of 1:2 to 1:10, preferably 1:3 to 1:5.

For strength reasons, the transition between the steps is advantageously formed by a radius so that the radius does not reduce the width of the groove bottom section measured parallel to the axis of the drill. Only the transition from the groove section having the least depth to the outside surface of the shaft may be formed advantageously with a concave curvature having a larger radius To achieve minimum friction losses in addition to affording optimum coordination between removal capacity and strength, in accordance with the present invention, the outside surface of the shaft between adjacent turns of the helical groove is less than the width of the groove having a stepped groove bottom of different depths measured in the axial direction of the drill as compared to that portion of the groove which has a uniform depth of the groove bottom. Advantageously, the axial width of the surface of the shaft between adjacent turns of the groove located adjacent the cutting bit is approximately twice as wide as the comparable outside surface of the shaft located along the adjoining rearward part of the shaft.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing

FIG. 1 is a partial side view of a rock drill embodying the present invention;

FIG. 2 is an axially extending sectional view through the rock drill in FIG. 1 taken along the line II-II as shown in FIGS. 1 and 3;

FIG. 3 is a partial side view of another preferred embodiment of the rock drill incorporating the present invention.

DETAILED DESCRIPTION OF THE INVENTION

Figure 4:
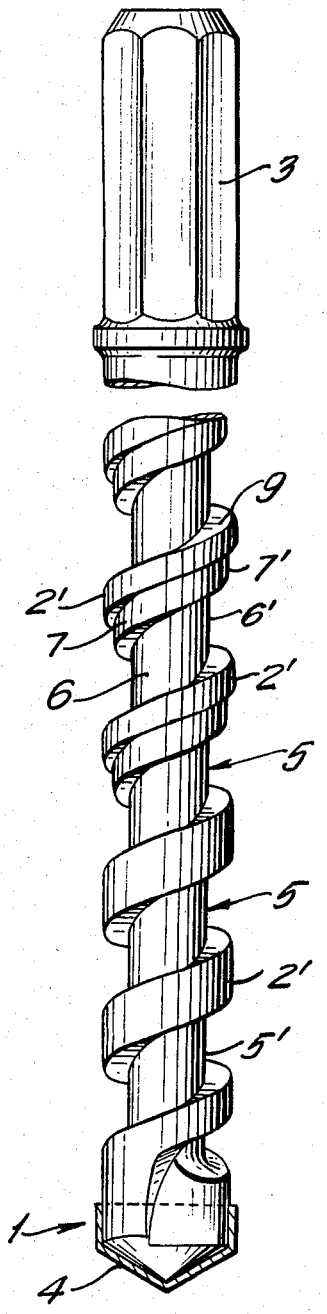
FIG. 4 is a partial side view of still another preferred embodiment of the rock drill incorporating the present invention.

In FIG. 1 a rock drill is shown formed of an axially elongated member having a cutting bit 1 at one end, the lower end as viewed in FIG. 1, a shaft 2 extending from the cutting bit and a shank 3 extending from the shaft and forming the opposite end of the drill.

Cutting bit 1 includes a hard metal cutting edge 4. Drill borings removed by the cutting bit 1 are conveyed through a removal groove 5 extending helically around the shaft from the cutting bit toward the shank 3. The removal groove is open to the cutting bit 1.

As illustrated in FIG. 2, the dimension B of the removal groove 5, viewed in the axial direction of the drill, is approximately 3.5 times the maximum depth T of the that is, the depth of the groove inwardly from the outside surface of the shaft 2. As can be seen in FIG. 2, removal groove 5 is divided in the axial direction into three sections 6, 7, 8, each having a different depth with the depths decreasing in the direction away from the cutting tip. The groove bottoms 6', 7', 8', each associated with one of the groove sections 6, 7, 8, extend parallel to the axis of the drill or of the shaft. The flank or side 9 of the removal groove closest to the cutting tip extends perpendicularly of the drill axis.

The stepped arrangement of the bottoms of the groove sections 6, 7, 8, does not have to extend axially or radially in a uniform manner. It may be advantageous, especially when a drill is used mainly in a soft material, if the groove section 6 extends for a greater axial dimension compared to the other groove section 7, 8, so that groove section 6 provides a relatively large receiving space for the drill borings.

In FIG. 3 another embodiment of the rock drill is shown having essentially the same structural features as illustrated in FIG. 1 and, therefore, for the most part the same reference numerals are used. A removal groove 5 is formed in the shaft 2 and is made up of a first part extending from the cutting bit 1 and having a groove bottom 5' of a uniform depth. A second part, extending rearwardly from the trailing end of the first part toward the shank 3, has stepped groove bottoms 6', 7', 8', each of a different depth so that the groove is divided into the groove sections 6, 7, 8. In the first part of the removal groove 5 adjacent the cutting bit 1, the remaining outside surface 2' of the shaft 2 has a dimension measured in the axial direction of the shaft which is approximately twice as wide as the outside surface 2' of the shaft in the region of the second part of the removal groove 5 having the stepped bottom surface.

As viewed in FIG. 3, the length in the axial direction of the drill from the cutting bit 1 to the start of the groove sections 6, 7, 8 of different depths is in the range of three to seven times the diameter of the cutting bit. In FIG. 4 and embodiment of the rock drill is shown similar to FIG. 1, using the same reference numerals, however, the plural section part of the groove has only two sections, 6, 7 each of a different depth.

While specific embodiments of the invention have been shown and described in detail to illustrate the application of the inventive principles, it will be understood that the invention may be embodied otherwise without departing from such principles.

We claim:

1. Rock drill comprising an axially elongated member having a cutting bit at one end, a shaft extending from said cutting bit toward the opposite end of said member, said shaft having an outside surface defining the radially outer surface of said shaft and at least one helically extending groove extending inwardly from said outside surface for conveying drill borings away from said cutting bit toward the opposite end of said member, and a shank extending from the opposite end of said member toward the end of said shaft remote from said cutting bit, in the axial section of said shaft said groove having a groove bottom extending parallel to the axis of said member and a flank closer to said cutting bit extending substantially perpendicular to the axis of said member, wherein the improvement comprises that said groove bottom at least for a part of the axial length of said shaft is divided in the axial direction into a plurality of sections each having a different depth inwardly from the outside surface of said shaft, said plural section part of said groove having a plurality of flanks spaced axially apart and extending substantially perpendicular to the axis of said member and including a first flank closest to said cutting bit, said first flank defining one side of a first said section of said groove having the greatest depth inwardly from the outside surface of said shaft and said first flank forms a continuous rectilinear line from the outside surface of said shaft to the bottom of said first section of said groove, the depth of said groove sections decreases in a stepwise manner inwardly from the outside surface of said shaft in the direction from said first flank toward the opposite end of said member, and said plural section part of said groove commences at a distance from said cutting bit in the range of three to seven times the diameter of said cutting bit.

2. Rock drill, as set forth in claim 1, wherein said plural section part of said groove having the groove sections of different depths extends from said shank toward said cutting tip.

3. Rock drill, as set forth in claim 1, wherein said plural section part of said groove having sections of different depths comprising two sections each of a different depth.

4. Rock drill, as set forth in claim 1, wherein said plural section part of said groove having sections of different depths comprising three sections each of a different depth.

5. Rock drill, as set forth in claim 1, wherein said plural section part of said groove having a ratio of maximum depth to width measured in the axial direction of said member in the range of between 1:2 and 1:10.

6. Rock drill, as set forth in claim 5, wherein said groove having a ratio of maximum depth to width measured in the axial direction of said member in the range of 1:3 to 1:5.

* * * * *